US007320315B2

(12) United States Patent
Amano et al.

(10) Patent No.: US 7,320,315 B2
(45) Date of Patent: Jan. 22, 2008

(54) FUEL VAPOR TREATMENT SYSTEM FOR INTERNAL COMBUSTION ENGINE

(75) Inventors: Noriyasu Amano, Gamagori (JP); Hideaki Itakura, Nagoya (JP); Makoto Otsubo, Nishio (JP); Kazuhiro Hayashi, Nishikamo-gun (JP); Shinsuke Takakura, Kariya (JP)

(73) Assignees: Denso Corporation, Kariya, Aichi-pref. (JP); Nippon Soken, Inc., Nishio, Aichi-pref. (JP)

( * ) Notice: Subject to any disclaimer, the term of this patent is extended or adjusted under 35 U.S.C. 154(b) by 0 days.

(21) Appl. No.: 11/699,572

(22) Filed: Jan. 30, 2007

(65) Prior Publication Data

US 2007/0175455 A1 Aug. 2, 2007

(30) Foreign Application Priority Data

Jan. 30, 2006 (JP) ..... 2006-021045

(51) Int. Cl.
*F02M 37/04* (2006.01)

(52) U.S. Cl. ..... 123/520; 123/357

(58) Field of Classification Search ..... 123/520, 123/519, 518, 516, 357, 494
See application file for complete search history.

(56) References Cited

U.S. PATENT DOCUMENTS 5,188,085 A 2/1993 Habaguchi et al.
5,699,778 A * 12/1997 Muraguchi et al. ..... 123/698
6,739,177 B2 * 5/2004 Sato et al. ..... 73/23.31
6,971,375 B2 12/2005 Amano et al.
7,171,960 B1 * 2/2007 Hagari ..... 123/698
2002/0066442 A1 * 6/2002 Muller et al.
2002/0139360 A1 * 10/2002 Sato et al. ..... 123/698
2003/0154963 A1 8/2003 Furushou
2003/0200958 A1 * 10/2003 Ito et al. ..... 123/520

FOREIGN PATENT DOCUMENTS

JP 7-189817 A 7/1995
JP 2004-116303 4/2004

OTHER PUBLICATIONS

European Search Report mailed Jun. 14, 2007 in European Application No. 07101160.5.
U.S. Appl. No. 11/529,278, Amano et al., filed Sep. 29, 2006, English counterpart of JP 2005-283940.

* cited by examiner

*Primary Examiner*—Carl Miller
(74) *Attorney, Agent, or Firm*—Nixon & Vanderhye P.C.

(57) ABSTRACT

A butterfly valve restricts flow passage areas of a purge passage and a blow-by gas passage by the same degree. A first pressure sensor detects variation in pressure of the purge gas, which is generated by the butterfly valve. A second pressure sensor detects variation in pressure of the blow-by gas, which is generated by the butterfly valve. Since a fuel vapor concentration of the blow-by gas is lower than that of the purge gas, the blow-by gas can be treated as air of 100%. Hence, the fuel vapor concentration is calculated based on the variations in pressure detected by the first pressure sensor and the second pressure sensor.

18 Claims, 9 Drawing Sheets

FUEL VAPOR TREATMENT SYSTEM FOR INTERNAL COMBUSTION ENGINE

CROSS-REFERENCE TO RELATED APPLICATION

This application is based on Japanese Patent Application No. 2006-21045 filed on Jan. 30, 2006, the disclosure of which is incorporated herein by reference.

FIELD OF THE INVENTION

The present invention relates to a fuel vapor treatment system for an internal combustion engine.

BACKGROUND OF THE INVENTION

A fuel vapor treatment system is used for preventing fuel vapor produced in a fuel tank from being dissipated into the atmosphere and introduces the fuel vapor in the fuel tank into a canister accommodating an adsorbent to adsorb the fuel vapor temporarily by the adsorbent. The fuel vapor adsorbed by the adsorbent is desorbed by negative pressure produced in an intake pike when an internal combustion engine is operated and is purged into the intake pipe of the internal combustion engine through a purge passage. When the fuel vapor is desorbed from the adsorbent in this manner, the adsorbing capacity of the adsorbent is recovered.

When the fuel vapor is purged, the flow rate of an air-fuel mixture containing the fuel vapor is adjusted by a purge control valve provided in the purge passage. However, to adjust the amount of fuel vapor actually purged into the intake pipe to a suitable air-fuel ratio by the purge control valve, it is important to measure the concentration of the fuel vapor in the air-fuel mixture flowing through the purge passage with high accuracy.

JP-2004-116303A shows a fuel vapor treatment apparatus having a throttle in a purge passage to calculate the fuel vapor concentration based on a differential pressure between upstream and downstream of the throttle. In this apparatus, the fuel vapor concentration is calculated based on a basic differential pressure in which the fuel vapor concentration is 0%. Since it is hard to practically create the condition in which the fuel vapor concentration is 0%, the basic differential pressure is pre-calculated and is stored in an ECU. However, the pre-calculated basic differential pressure may have errors in a case that the pressure sensor is deteriorated or a pressure loss in the treatment system is varied with age. The differential pressure in the throttle depends on density of fluid flowing through the throttle. When the ambient pressure or ambient temperature is varied, the density is also varied, which may cause errors.

SUMMARY OF THE INVENTION

The present invention has been made in view of the above-mentioned points. The object of the invention is to provide a fuel vapor treatment system of an internal combustion engine in which the fuel vapor concentration can be measured with high accuracy.

To achieve the above-mentioned object, a fuel vapor treatment system includes following structure. That is, the system includes a canister that is connected to a fuel tank through a vapor introduction passage. The canister has an adsorbent for temporarily adsorbing fuel vapor. The fuel vapor produced in the fuel tank is introduced into the canister through the fuel vapor introduction passage. The system further includes a purge passage introducing a desorbed fuel vapor from the adsorbent into an intake pipe of the engine, and a purge valve provided in the purge passage. The purge valve controls a flow rate of fuel vapor flowing through the purge passage. The system further includes a first throttle provided in the purge passage, a first pressure detecting means for detecting a variation in pressure of a purge gas passing through the first throttle. The system further includes a second throttle provided in a gas passage of a positive crankcase ventilation apparatus that recirculates a blow-by gas into the intake pipe, and a second pressure detecting means for detecting a variation in pressure of a gas passing through the second throttle. A concentration calculation means for calculating a concentration of fuel vapor in an air-fuel mixture introduced into the intake pipe from the canister based on the variation in pressure detected by the first pressure detecting means and the variation in pressure detected by the second pressure detecting means.

BRIEF DESCRIPTION OF THE DRAWINGS

Other objects, feature and advantages of the present invention will become more apparent from the following detailed description made with reference to the accompanying drawings, in which like parts are designated by like reference numbers and in which.

DETAILED DESCRIPTION OF THE PREFERRED EMBODIMENTS

Figure 1:
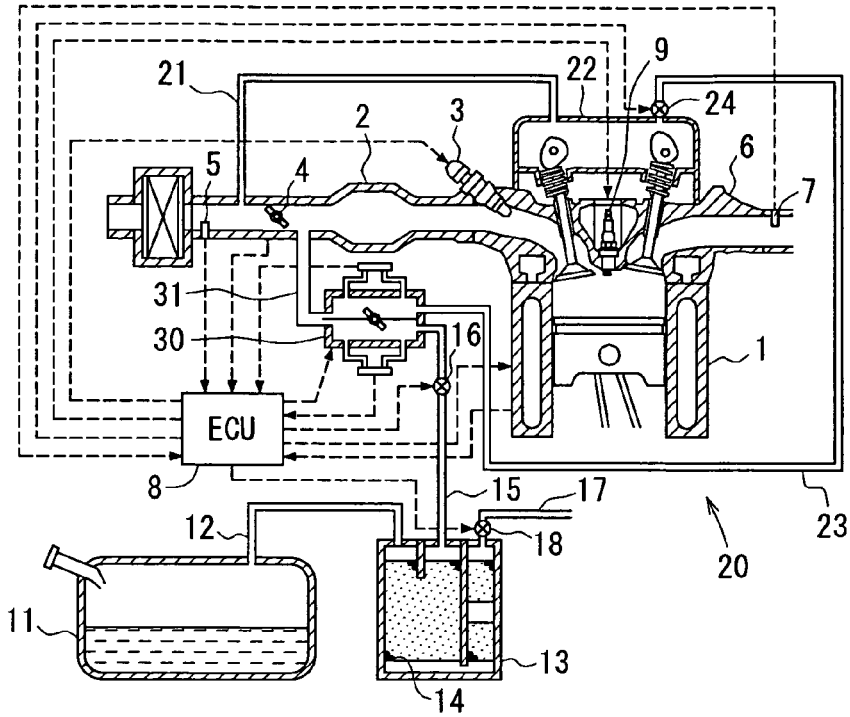
FIG. 1 is a schematic view showing a fuel vapor treatment system according to a first embodiment of the invention.

Hereinafter, the preferred embodiment of the invention will be described. FIG. 1 is a construction diagram to show the construction of a fuel vapor treatment system according to an embodiment of the invention. The fuel vapor treatment system is applied to the engine of an automobile.

A fuel injector 3, a throttle valve 4 and an airflow sensor 5 are provided in an intake pipe 2 of an engine 1. An air-fuel ratio sensor 7 is provided in an exhaust pipe 6.

An ECU 8 receives signals from the airflow sensor 5, the air-fuel ratio sensor 7, a crank angle sensor (not shown), and a vehicle speed sensor (not shown) to control the throttle valve 4, an injector 3, and an ignition plug 9.

A fuel tank 11 communicates with a canister 13 via a fuel vapor introduction passage 12. Fuel vapor generated in the fuel tank 11 flows into the canister 13 through the fuel vapor introduction passage 12. The canister 13 accommodates adsorbent 14. The fuel vapor is adsorbed by the adsorbent 14. The canister 13 communicates with the intake pipe 2 via a purge passage 15.

A purge valve 16 is provided in the purge passage 15. The purge valve 16 controls quantity of fuel vapor which is purged into the intake pipe 2 so that air-fuel ratio is brought to be stoichiometric ratio.

The canister 13 communicates with atmosphere through an atmosphere passage 17. The atmosphere passage 17 is provided with a close valve 18.

A positive crankcase ventilation apparatus 20 recirculates blow-by gas into the intake pipe 2. The apparatus 20 includes an introduce passage 21 and a discharge passage 23. One end of the introduce passage 21 is connected to the intake pipe 2 upstream of the throttle valve 4, and the other end is connected to a head cover 22 of the engine 1. Fresh air flows through the introduce passage 21. One end of the discharge passage 23 is connected to the head cover 22, and the other end is connected to the intake pipe 2 downstream of the throttle valve 4 via a fuel vapor concentration detector 30 and a passage 31. An interior of the head cover 22 communicates with an interior of a crankcase. Blow-by gas flows through the discharge passage 23 and is discharged into the intake pipe 2. The passages 21, 23 may be connected to the crankcase instead of the head cover 22.

The discharge passage 23 is provided with a blow-by gas control valve 24. The opening degree of the valve 24 is controlled by the ECU 8.

The fuel vapor concentration detector 30 is connected to the purge passage 15 and the discharge passage 23. The purge gas is introduced into the detector 30 through the purge passage 15, and the blow-by gas is introduced into the detector 30 through the discharge passage 23. The purged gas and the blow-by gas in the detector 30 are introduced into the intake pipe 2 through a passage 31.

Figure 2:
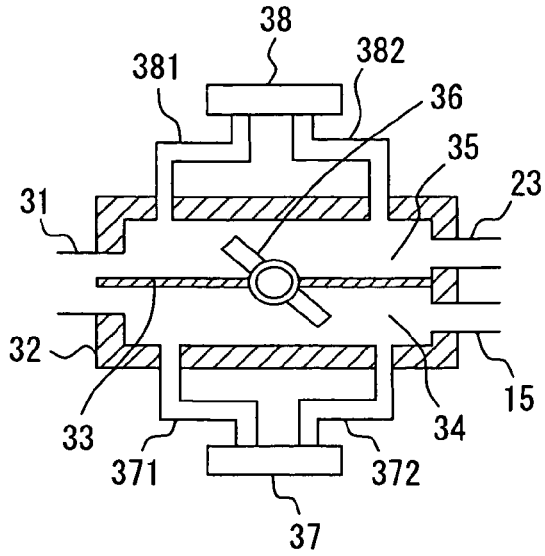
FIG. 2 is cross sectional view showing a fuel vapor concentration detector shown in FIG. 1.

FIG. 2 shows the fuel vapor concentration detector 30 in detail. The detector 30 has a case 32. The purge passage 15 and the discharge passage 23 are connected to the case 32 at a first surface thereof. The passage 31 is connected to the case 32 at a second surface thereof.

A partition 33 is provided in the concentration detector 30 to prevent a mixture of the purge gas and the blow-by gas. The partition 33 defines a first chamber 34 and a second chamber 35 with the case 32. The partition 33 is arranged in such a manner that flow passage areas of the chambers 34, 35 are substantially identical to each other. The first chamber 34 and the second chamber 35 are defined in parallel to each other.

A butterfly valve 36 is provided in the center of the case 32. The rotational position of the butterfly valve 36 is controlled by the ECU 8. When the butterfly valve 36 varies its rotational position, the first chamber 34 and the second chamber 35 are identically restricted to define the same flow passage area. The butterfly valve 36 corresponds to a first and a second throttle. The flow passage areas are identical between the chambers 34, 35 irrespective of the butterfly valve position.

A first pressure sensor 37 is provided outside of the first chamber 34. The sensor 37 communicates to the interior of the first chamber 34 through passages 371, 372. The first pressure sensor 37 measures a differential pressure between upstream and downstream of the butterfly valve 36. This differential pressure represents variation in pressure of the purge gas flowing through the first chamber 34. In this situation, the butterfly valve 36 functions as the first throttle.

A second pressure sensor 38 is provided outside of the second chamber 35. The sensor 38 communicates to the interior of the second chamber 35 through passages 381, 382. The second pressure sensor 38 measures a differential pressure between upstream and downstream of the butterfly valve 36. This differential pressure represents variation in pressure of the blow-by gas flowing through the second chamber 35. In this situation, the butterfly valve 36 functions as the second throttle. These measured differential pressures are electrically sent to the ECU 8.

Figure 3:
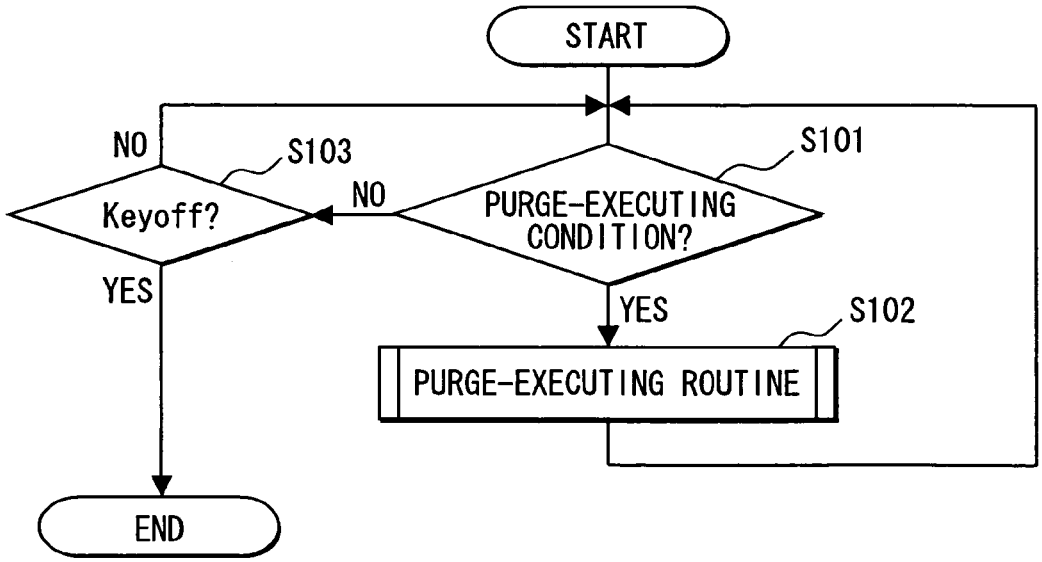
FIG. 3 is a main flow chart according to the first embodiment.

FIG. 3 is a main flowchart, which is executed when the engine 1 is turned on. In step S101, a computer determines whether a purge-executing condition is established. The purge-executing condition is determined based on an engine condition including an engine coolant temperature, an oil temperature, and an engine speed.

When the answer is Yes in step S101, the procedure proceeds to step S102 in which a purge-executing routine is executed. After the purge-executing routine is executed, the procedure goes back to step S101. When the answer is No in step S101, the procedure proceeds to step S103 in which the computer determined whether the engine is turned off.

Figure 4:
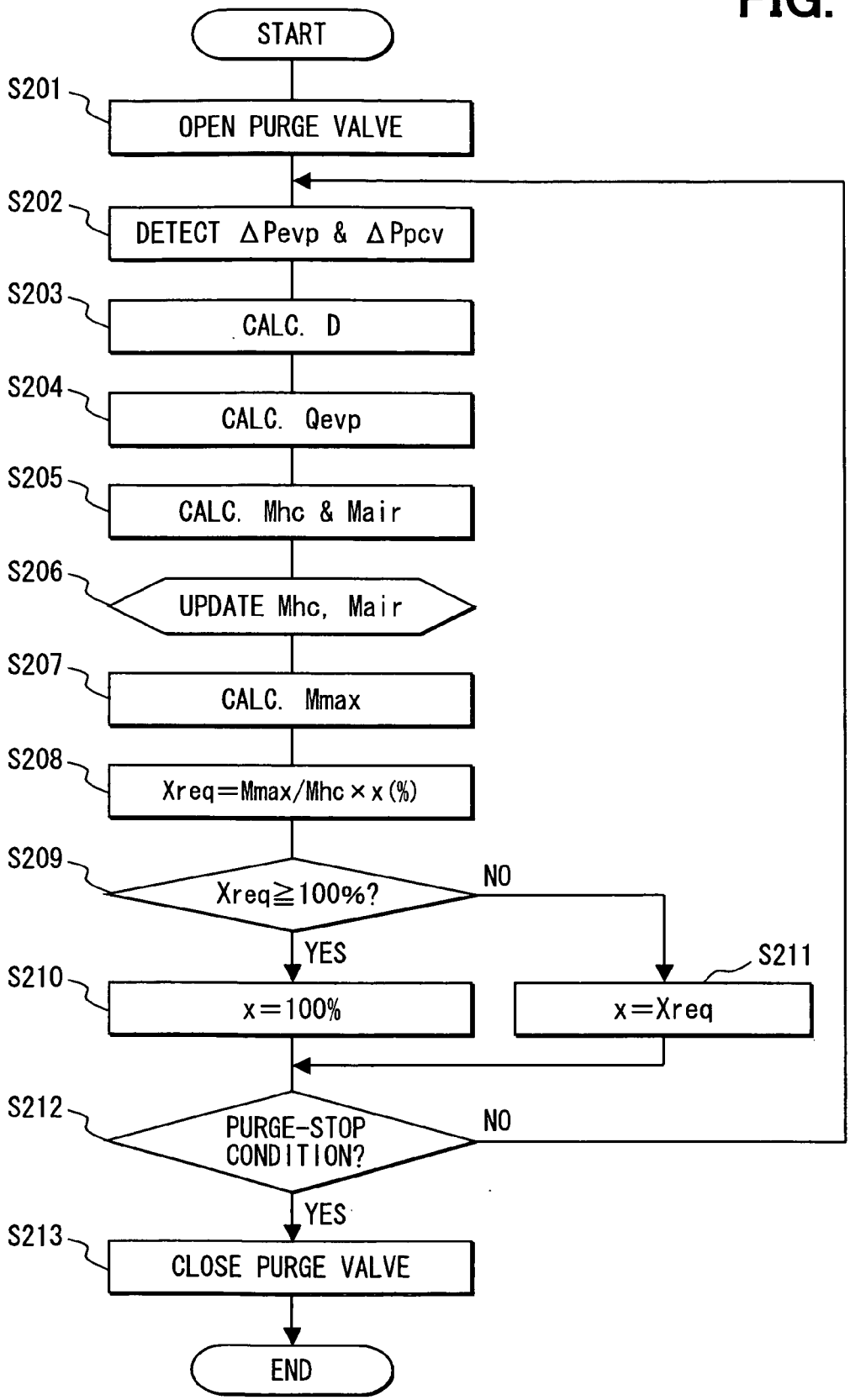
FIG. 4 is a flow chart showing a purge-executing routine shown in FIG. 3.
Figure 5A:
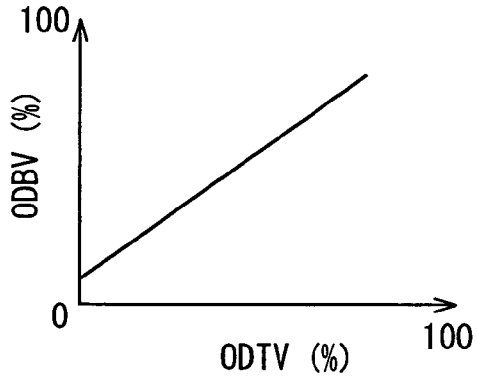
FIGS. 5A and 5B are graphs showing a relationship between a throttle valve opening degree and a butterfly valve opening degree.
Figure 5B:
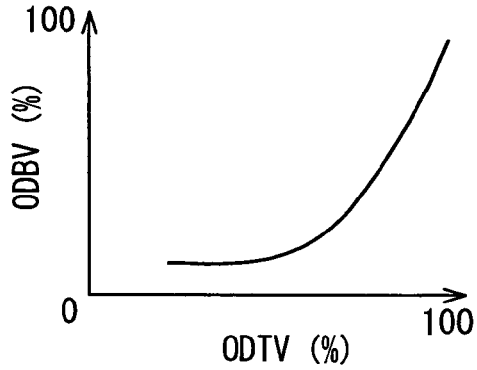

FIG. 4 is a flowchart showing the purge-executing routine. Before the purge-executing routine is executed, the position of the butterfly valve 36 is set to a predetermined position corresponding to the position of the throttle valve 4. As the opening degree of the throttle valve 4 increases, the opening degree of the butterfly valve 36 increases. As shown in FIG. 5A, the opening degree of the butterfly valve 36, which is referred to as the ODBV hereinafter, may linearly increase with respect to the opening degree of the throttle valve, which is referred to as the ODTV hereinafter. Alternatively, as the ODTV increases, an increasing rate of the ODBV may be increased, as shown in FIG. 5B. The relationship between the ODBV and the ODTV is stored in the ECU 8 beforehand. The ODBV is controlled based on the actual ODTV.

As the ODTV is increased, the amount of blow-by gas increases. Even if the ODTV is increased to reduce the negative pressure downstream of the throttle valve, the blow-by gas does not flow upstream. That is, the blow-by gas is introduced into the intake pipe 2 without fail.

In step S201, the purge valve 16 is opened by a predetermined degree "x". This degree "x" is determined based on the engine-driving condition, the differential pressure detected by the second pressure sensor 38, and the like.

In step S202, the first pressure sensor 37 detects the purge gas differential pressure ΔPevp, and the second pressure sensor 38 detects the blow-by gas differential pressure ΔPpcv.

In step S203, a fuel vapor concentration D in the purged gas is calculated based on the pressure ΔPevp and the pressure ΔPpcv.

The method of calculating the fuel vapor concentration D will be described hereinafter. The flow rate of fluid passing through a throttle, which corresponds to the butterfly valve 36, is expressed by the following equation (1) according to Bernoulli's theorem.

$$Q=K(\Delta P/\rho)^{1/2} \quad (1)$$

wherein ρ represents a density of fluid passing through the throttle, ΔP represents the differential pressure of fluid passing through the throttle, and K is a constant number. In a case that the opening area of the throttle is represented by S, it is derived that $K=\alpha\times S\times 2^{1/2}$. A flow rate coefficient of the throttle is denoted by α.

The quantity of purge gas flowing through the first chamber 34 is expressed by the following equation (2), and the quantity of blow-by gas flowing through the second chamber 35 is expressed by the following equation (3).

$$Qevp^2=K1\times\Delta Pevp/\rho evp \quad (2)$$

$$Qpcv^2=K2\times\Delta Ppcv/\rho pcv \quad (3)$$

In the above equations (2), (3), the suffix "evp" represents the purge gas and the suffix "pcv" represents the blow-by gas. Furthermore, $K1=\alpha evp^2\times Sevo^2\times 2$, and $K2=\alpha pcv^2\times Spcv^2\times 2$.

Here, the fuel vapor concentration in the blow-by gas is very low, comparing with the fuel vapor concentration in the purge gas. Hence, it can be assumed that the fuel vapor concentration in blow-by gas is 0%. That is, the blow-by gas is almost the same as the air with respect to the fuel vapor concentration. Thus, the equation (3) can be rewritten into the following equation (4). The suffix "air" represents atmosphere.

$$Qpcv^2=K2\times\Delta Ppcv/\rho air \quad (4)$$

Figure 6:
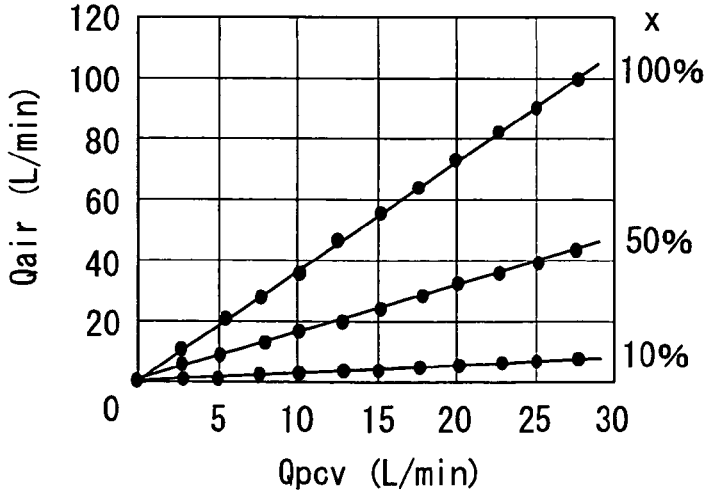
FIG. 6 is a graph showing a relationship between a quantity of blow-by gas and a quantity of purge gas of which fuel vapor concentration is 0%.

In a case that the purge gas is air of which flow rate is expressed by Qair, the relationship between Qair and Qpcv is varied according to the pressure loss in each passage and the purge valve opening degree "x". As shown in FIG. 6, Qair and Qpcv have a proportional relation with respect to each degree "x". Hence, following equation (5) can be established.

$$Qair=K3\times Qpcv \quad (5)$$

K3 is an inclination of line in FIG. 6. The relationship between K3 and "x" can be obtained beforehand. This relationship is stored in the ECU 8. K3 can be obtained based on the stored relationship and the current degree "x".

Figure 7:
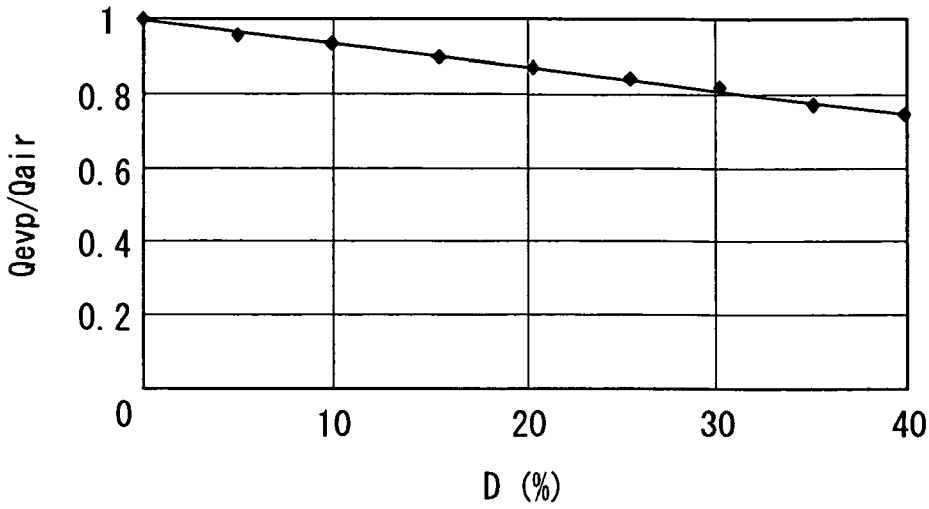
FIG. 7 is a graph showing a relationship between a fuel vapor concentration and a ratio between a purge gas quantity and a purge gas quantity of which fuel vapor concentration is 0%.

In practice, the purge gas contains fuel vapor. The flow rate of the purge gas decreases according to the fuel vapor concentration D even in the same intake pressure, as shown in FIG. 7. The relationship between Qair and Qevp is expressed by the following equation (6).

$$Qevp/Qair=K4\times D \quad (6)$$

K4 is an inclination of line in FIG. 7. Based on the equations (2), (4), (5), (6), the following equation (7) can be obtained.

$$\rho evp=K/D^2\times\Delta Pevp/\Delta Ppcv\times\rho air \quad (7)$$

wherein $K=K1/(K2\times K3^2\times K4^2)$

K1 contains the opening area Sevp of the throttle, and K2 contains the opening area Spcv of the throttle. In this embodiment, Sevp is equal to Spcv irrespective of the butterfly valve position. Thus, these terms cancels to each other, so that K is simplified to reduce calculation time period.

In a case that air density is denoted by ρair and density of fuel vapor 100% is denoted by ρhc, the fuel vapor concentration D(%) is expressed by the following equation (8).

$$D=100\times(\rho evp-\rho air)/(\rho hc-\rho air) \quad (8)$$

Based on the equations (7), (8), the following equation (9) can be derived.

$$(\rho hc-\rho air)\times\Delta Ppcv\times D^3+100\times\Delta Ppcv\times\rho air\times D^2-100\times K\times\Delta Pevp\times\rho air=0 \quad (9)$$

In this equation (9), since ρair and ρhc are physical values, the fuel vapor concentration D can be obtained from ΔPpcv and ΔPevp.

In step S204, the computer calculates the purge gas flow rate Qevp. The purge gas flow rate Qevp can be obtained from the fuel vapor concentration D which is calculated according to the equation (6).

Since the air-fuel ratio is controlled based on a mass flow rate thereof, a purged fuel vapor mass flow rate Mhc and a purged air mass flow rate Mair are obtained in step S205. These mass flow rate can be obtained according to following equations (10), (11).

$$Mhc=Qevp\times D/100\times\rho hc \quad (10)$$

$$Mair=Qevp\times(1-D/100)\times\rho air \quad (11)$$

In step S206, the purged fuel vapor mass flow rate Mhc and the purged air mass flow rate Mair are stored in RAM. An air-fuel ratio controller controls the fuel injection quantity and the air-fuel ratio based on these values.

In step S207, permissible maximum value Mmax of the purged fuel vapor quantity is calculated. The value Mmax is determined based on the engine driving condition and a controllable range of the injector.

In step S208, a required purge valve opening degree Xreq is calculated. The required opening degree Xreq(%) is derived from a following equation (12) in a case where the present purge valve opening degree is X(%).

$$Xreq=Mmax/Mhc\times X \quad (12)$$

In step S209, the computer determines whether the required opening degree Xreq is equal to or larger than 100%. When the answer is Yes, the procedure proceeds to step S210 in which the opening degree of the purge valve 16 is set to 100%. When the answer is No, the procedure proceeds to step S211 in which the opening degree of the purge valve 16 is set to Xreq(%).

In step S212, the computer determines whether a purge-stop condition is established. The purge-stop condition is determined based on the engine condition such as the engine coolant temperature, the engine oil temperature, and the engine speed. When the purge-stop condition is established, the procedure proceeds to step S213 in which the purge valve 16 is closed to end the routine. When the purge-stop condition is not established, the procedure goes back to step S202.

As described above, according to the embodiment, the butterfly valve 36 restricts the flow area of the purge gas and blow-by gas. The fuel vapor concentration D, the purged fuel vapor mass flow rate Mhc, and the purged air mass flow rate Mair are obtained based on the purge gas differential pressure ΔPevp and the blow-by gas differential pressure ΔPpcv. Hence, the concentration D, the mass flow rate Mhc, Mair can be calculated in real time.

Since the measuring points of the differential pressures ΔPevp, ΔPpcv are adjacent to each other and the differential pressures ΔPevp, ΔPpcv are measured in real time, there differential pressures can be detected with high accuracy without receiving influence from the ambient condition.

Second Embodiment

Figure 8:
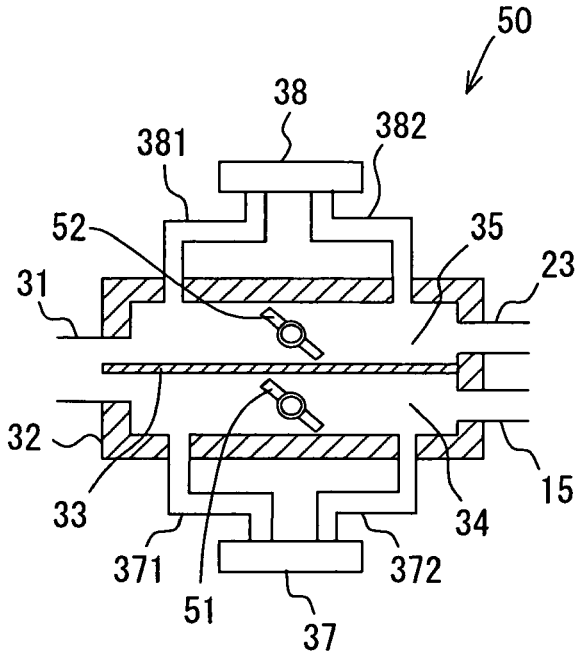
FIG. 8 is a cross sectional view showing a fuel vapor concentration detector according to a second embodiment.

FIG. 8 shows a fuel vapor concentration detector 50. The detector 50 is provided with a first butterfly valve 51 and a second butterfly valve 52. The shapes of these butterfly valves are identical to each other. The first butterfly valve 51 is disposed in the first chamber 34 and the second butterfly valve 52 is disposed in the second chamber 35. The ECU 8 controls these valves 51, 52 in such a manner that the opening degrees of the valves are identical to each other.

Third Embodiment

Figure 9:
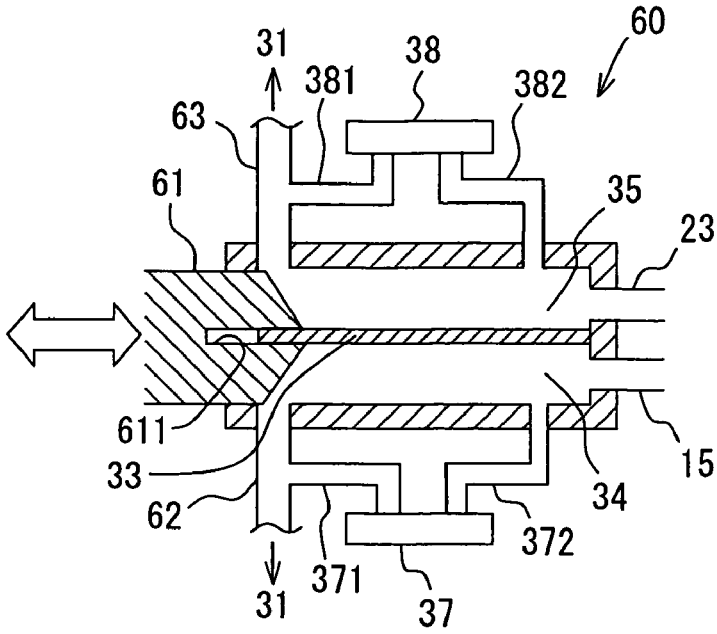
FIG. 9 is a cross sectional view showing a fuel vapor concentration detector according to a third embodiment.

FIG. 9 shows a fuel vapor concentration detector 60. The detector 60 is provided with a needle valve 61 which functions as the first throttle and the second throttle. The needle valve 61 is inserted into the case 32 and is provided with a slot 611 which receives the partition 33. The needle valve 61 moves right and left in FIG. 9. A center axis of the needle valve 61 is on the partition 33. The opening areas of the chambers 34, 35 are identical to each other irrespective of the position of the needle valve. The passage 371 is connected to a communication passage 62, and the passage 381 is connected to a communication passage 63. The communication passage 62 connects the first chamber 34 and the passage 31. The communication passage 63 connects the second chamber 35 and the passage 31.

Fourth Embodiment

Figure 10:
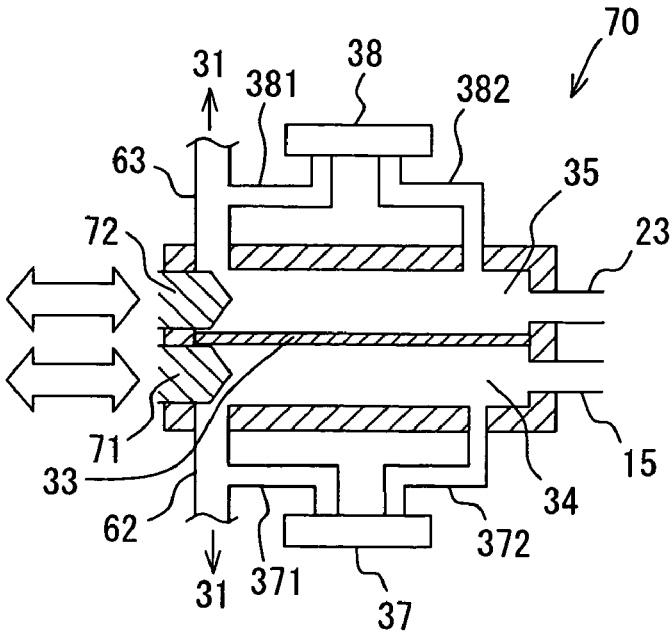
FIG. 10 is a cross sectional view showing a fuel vapor concentration detector according to a fourth embodiment.

FIG. 10 shows a fuel vapor concentration detector 70. The detector 70 is provided with a first needle valve 71 and a second needle valve 72. These needle valves 71, 72 have the same shape and move right and left in FIG. 10. The ECU 8 controls the position of these needle valves 71, 72.

Fifth Embodiment

Figure 11:
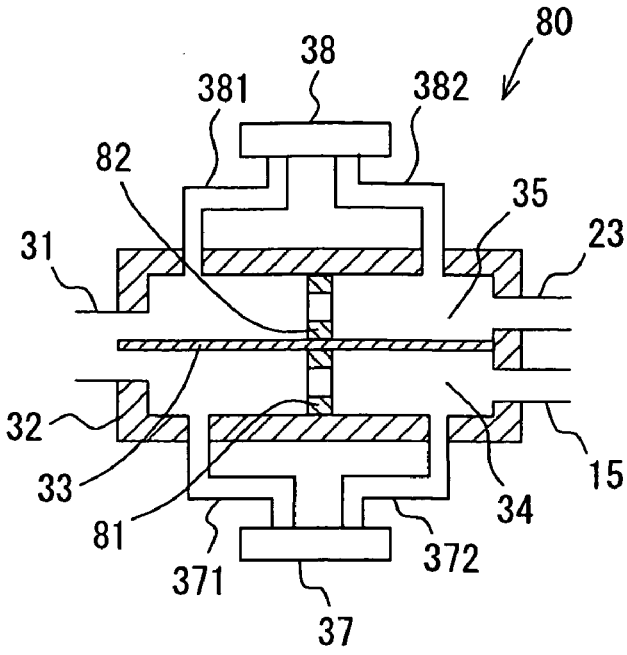
FIG. 11 is a cross sectional view showing a fuel vapor concentration detector according to a fifth embodiment.

FIG. 11 shows a fuel vapor concentration detector 80. The detector 80 is provided with a first orifice 81 and a second orifice 82, which are respectively provided in a center of the chambers 34, 35. The opening areas of the orifices 81, 82 are identical to each other.

Sixth Embodiment

Figure 12:
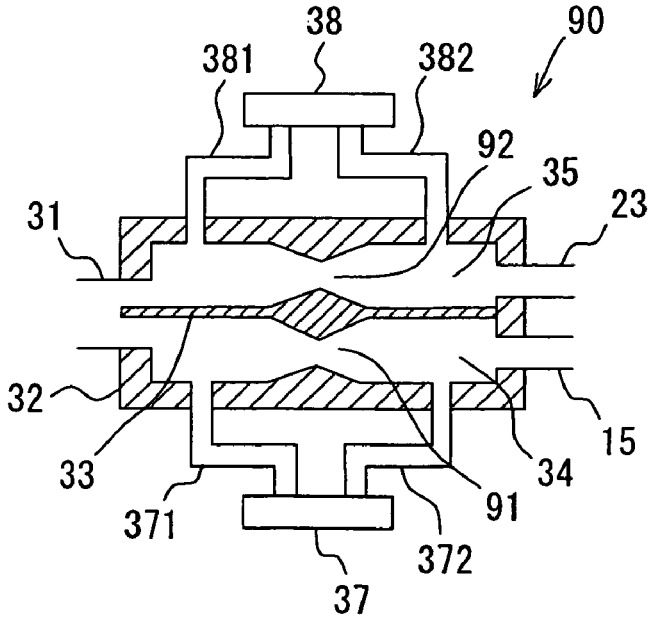
FIG. 12 is a cross sectional view showing a fuel vapor concentration detector according to a sixth embodiment.

FIG. 12 shows a fuel vapor concentration detector 90. The detector 90 is provided with a fist nozzle 91 and a second nozzle 92 in each chamber 34, 35. The opening areas of the nozzles 91, 92 are identical to each other.

Modification

Figure 13:
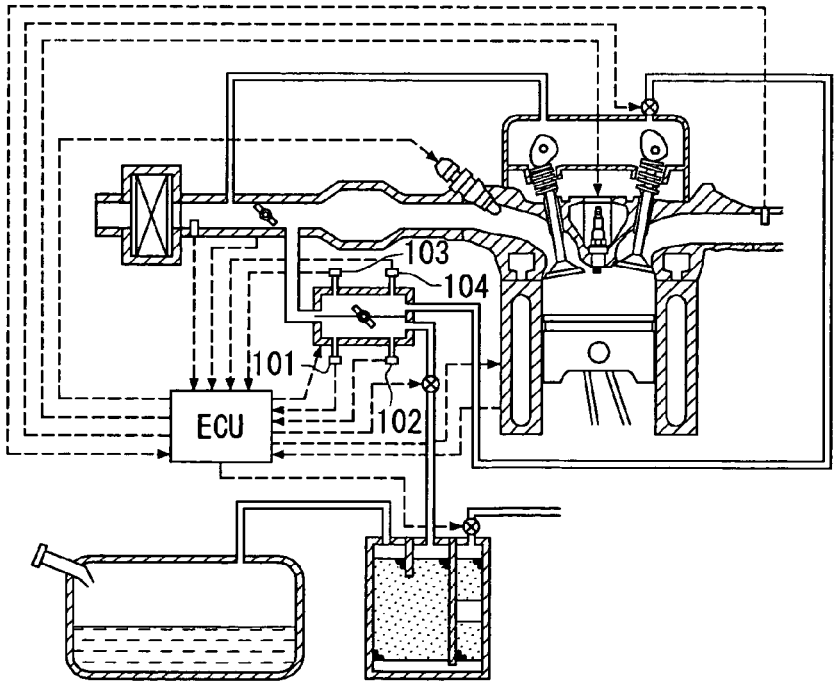
FIG. 13 is a schematic view showing a fuel vapor treatment system in which a pair of absolute pressure sensor is used.

As shown in FIG. 13, two pair of absolute pressure sensors 101, 102, 103, 104 can be used to detect differential pressure. The ECU 8 calculates the differential pressure based on the detected signals from the sensors 101-104.

Figure 14:
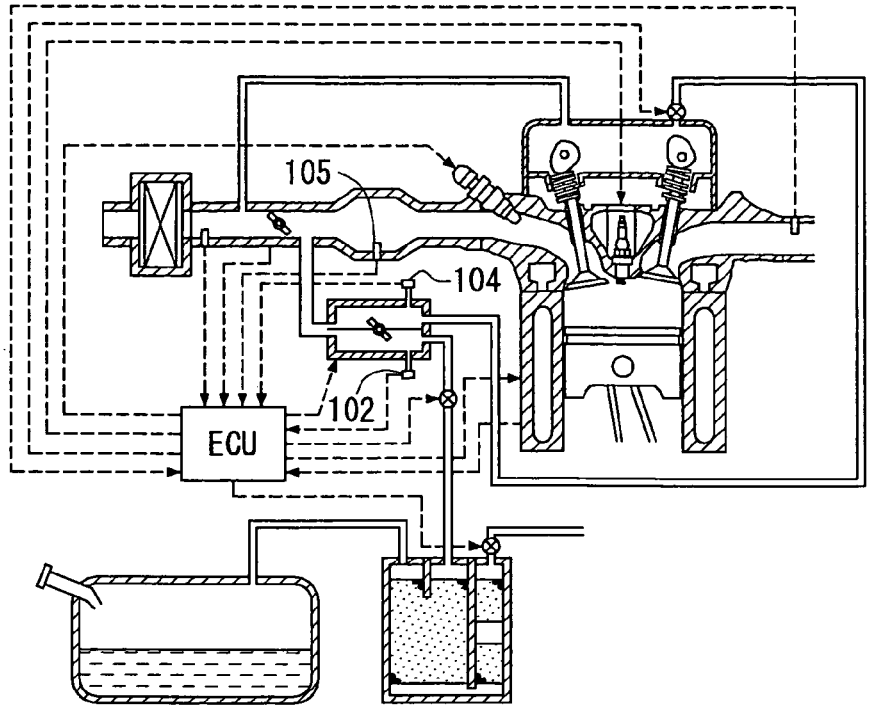
FIG. 14 is a schematic view showing a fuel vapor treatment system in which an intake air pressure sensor is used as an absolute pressure sensor.

As shown in FIG. 14, an intake air pressure sensor 105 can be provided downstream of the throttle valve 4. Absolute pressure sensors 102, 104 are respectively provided in each chamber 34, 35. A first pressure detector is constructed of the sensor 105 and the sensor 102, and a second pressure detector is constructed of the sensor 105 and the sensor 104.

Figure 15:
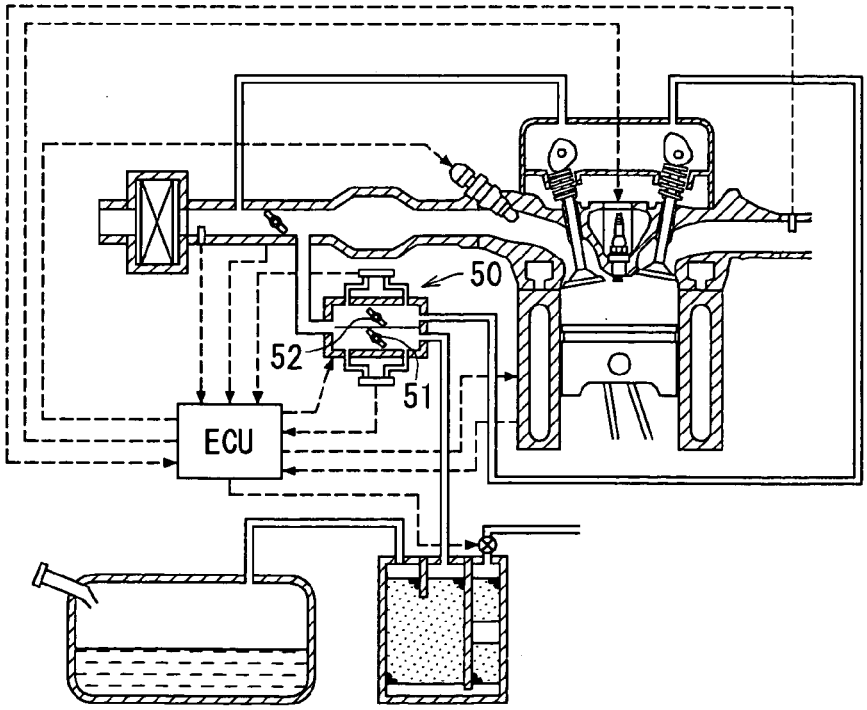
FIG. 15 is a schematic view showing a fuel vapor treatment system in which two butterfly valves are used.

As shown in FIG. 15, the butterfly valve 51 can function as the purge valve. The butterfly valve 52 can function as the blow-by gas control valve.

When the opening areas of the throttles are different from each other, a correction procedure is needed to correct a difference in flow rate.

Figure 16A:
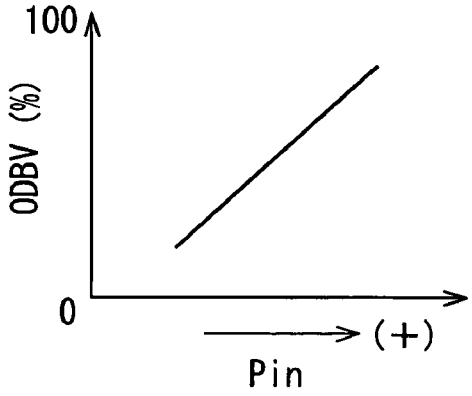
FIGS. 16A and 16B are graphs showing a relationship between an intake air pressure and a butterfly valve opening degree.
Figure 16B:
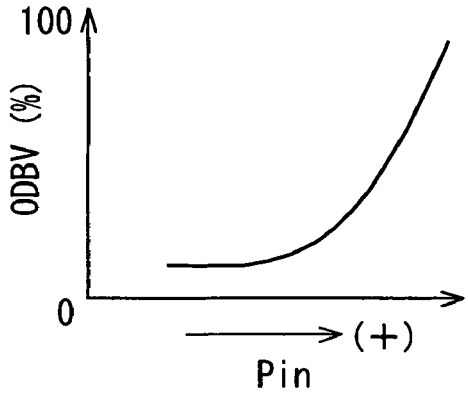
Figure 17A:
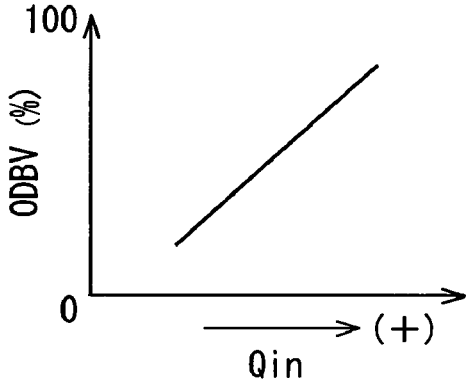
FIGS. 17A and 17B are graphs showing a relationship between an intake air quantity and a butterfly valve opening degree.
Figure 17B:
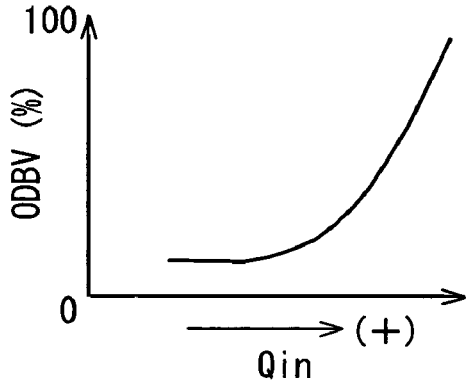

In the first embodiment, the ODBV can be determined based on an intake air pressure Pin as shown in FIGS. 16A, 16B. Alternatively, the ODBV can be determined based on an intake air quantity Qin.

What is claimed is:

1. A fuel vapor treatment system for an internal combustion engine, comprising:

a canister that is connected to a fuel tank through a vapor introduction passage and has an adsorbent for temporarily adsorbing fuel vapor, the fuel vapor being produced in the fuel tank and being introduced into the canister through the fuel vapor introduction passage;

a purge passage introducing a desorbed fuel vapor from the adsorbent into an intake pipe of the engine;

a purge valve provided in the purge passage, the purge valve controlling a flow rate of fuel vapor flowing through the purge passage;

a first throttle provided in the purge passage;

a first pressure detecting means for detecting a variation in pressure of a purge gas passing through the first throttle;

a second throttle provided in a gas passage of a positive crankcase ventilation apparatus that recirculates a blow-by gas into the intake pipe;

a second pressure detecting means for detecting a variation in pressure of a gas passing through the second throttle; and a concentration calculation means for calculating a concentration of fuel vapor in an air-fuel mixture introduced into the intake pipe from the canister based on the variation in pressure detected by the first pressure detecting means and the variation in pressure detected by the second pressure detecting means.

2. A fuel vapor treatment system for an internal combustion engine, comprising:

a canister that is connected to a fuel tank through a vapor introduction passage and has an adsorbent for temporarily adsorbing fuel vapor, the fuel vapor being produced in the fuel tank and being introduced into the canister through the fuel vapor introduction passage;

a purge passage introducing a desorbed fuel vapor from the adsorbent into an intake pipe of the engine;

a purge valve provided in the purge passage, the purge valve controlling a flow rate of fuel vapor flowing through the purge passage;

a first throttle provided in the purge passage;

a first pressure detecting means for detecting a variation in pressure of a purge gas passing through the first throttle;

a second throttle provided in a gas passage of a positive crankcase ventilation apparatus that recirculates a blow-by gas into the intake pipe;

a second pressure detecting means for detecting a variation in pressure of a gas passing through the second throttle;

a first quantity calculation means for calculating a quantity of fuel vapor in an air-fuel mixture introduced into the intake pipe from the canister based on the variation in pressure detected by the first pressure detecting means and the variation in pressure detected by the second pressure detecting means; and a second quantity calculation means for calculating a quantity of air in an air-fuel mixture introduced into the intake pipe from the canister based on the variation in pressure detected by the first pressure detecting means and the variation in pressure detected by the second pressure detecting means.

3. A fuel vapor treatment system according to claim 1, wherein the first pressure detecting means detects a differential pressure between two points across the first throttle in the purge passage.

4. A fuel vapor treatment system according to claim 1, wherein the second pressure detecting means detects a differential pressure between two points across the second throttle in the gas passage.

5. A fuel vapor treatment system according to claim 1, wherein the first throttle and the second throttle are arranged in such a manner as to be close to each other.

6. A fuel vapor treatment system according to claim 1, wherein the first throttle and the second throttle are adjacently arranged to each other.

7. A fuel vapor treatment system according to claim 1, wherein at least one of the first throttle and the second throttle is a valve.

8. A fuel vapor treatment system according to claim 6, wherein the first throttle and the second throttle is structured by a butterfly valve which turns in the purge passage and the gas passage so that a flow passage areas of the purge passage and the gas passage are identical to each other.

9. A fuel vapor treatment system according to claim 1, wherein the first throttle is a first butterfly valve provided in the purge passage, the second throttle is a second butterfly valve provided in the gas passage, and the first and the second butterfly valve are driven in such a manner that flow passage areas of the purge passage and the gas passage are identical to each other.

10. A fuel vapor treatment system according to claim 6, wherein the first throttle and the second throttle is structured by a needle valve which reciprocates in the purge passage and the gas passage so that a flow passage areas of the purge passage and the gas passage are identical to each other.

11. A fuel vapor treatment system according to claim 1, wherein the first throttle is a first needle valve provided in the purge passage, the second throttle is a second needle valve provided in the gas passage, and the first and the second needle valve are operated in such a manner that flow passage areas of the purge passage and the gas passage are identical to each other.

12. A fuel vapor treatment system according to claim 7, wherein an opening degree of the valve is controlled according to a throttle valve position, an intake air pressure, or an intake air quantity.

13. A fuel vapor treatment system according to claim 1, wherein the first throttle and the second throttle are structure by orifices of which opening degrees are identical to each other.

14. A fuel vapor treatment system according to claim 1, wherein the first throttle and the second throttle are structure by nozzles of which opening degrees are identical to each other.

15. A fuel vapor treatment system according to claim 1, wherein the purge valve functions as the first throttle.

16. A fuel vapor treatment system according to claim 1, wherein the second throttle is a blow-by gas control valve which is provided in the gas passage to control a flow rate of the blow-by gas.

17. A fuel vapor treatment system according to claim 1, wherein the first pressure detecting means includes a pressure sensor detecting a pressure upstream of the first throttle and an intake pressure sensor detecting an intake air pressure in the intake pipe.

18. A fuel vapor treatment system according to claim 1, wherein the second pressure detecting means includes a pressure sensor detecting a pressure upstream of the second throttle and an intake pressure sensor detecting an intake air pressure in the intake pipe.

* * * * *